United States Patent [19]

Pritchard

[11] 3,991,684

[45] Nov. 16, 1976

[54] BONE PIERCING HUNTING BULLET

[75] Inventor: Dennis S. Pritchard, Apo, Md.

[73] Assignee: Raymond Lee Organization, Inc., New York, N.Y.

[22] Filed: Oct. 21, 1975

[21] Appl. No.: 624,324

[52] U.S. Cl. ..... 102/92.2; 102/52; 102/91

[51] Int. Cl.[2] ..... F42B 11/00

[58] Field of Search ..... 102/52, 92.1–92.7, 102/91

[56] References Cited

UNITED STATES PATENTS

| | | | |
|---|---|---|---|
| 854,923 | 5/1907 | Broad | 102/91 |
| 1,096,558 | 5/1914 | Newton | 102/91 |
| 1,155,901 | 10/1915 | Duncan | 102/91 |
| 1,447,478 | 3/1923 | Koshollek et al. | 102/91 |
| 1,833,645 | 11/1931 | Hartz | 102/91 |
| 2,838,000 | 6/1958 | Schreiber | 102/92.2 |
| 3,282,214 | 11/1966 | Briscoe | 102/91 X |

*Primary Examiner*—Harold Tudor
*Attorney, Agent, or Firm*—Stephen Wyden

[57] ABSTRACT

A copper jacketed bullet with two V-shaped ogive shaped steel tips mounted in the ogive lead tip of the bullet to penetrate further into an animal as the lead tip of the bullet mushrooms increasing the killing power of the bullet.

1 Claim, 4 Drawing Figures

BONE PIERCING HUNTING BULLET

I have invented a new and novel bone piercing hunting bullet. My bullet will pierce an animal and will penetrate through bones, if necessary, to destroy the internal soft tissues, the destruction of which is so important for the humane killing of animals. My bullet minimizes the chances that an animal that is hit will wander in pain for a time before dying.

My invention can be understood in view of the accompanying figures.

Figure 1:
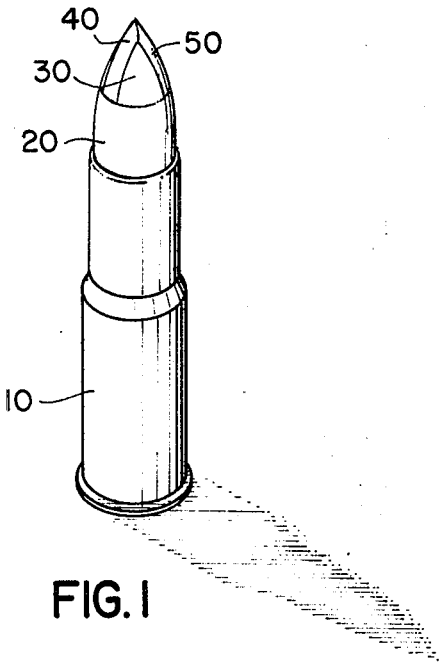
FIG. 1 shows the assembled bullet in a casing.

In FIG. 1, a bullet casing 10 holds a copper jacketed 20 projectile 30. In the tip of the lead projectile 30 are embedded two steel tips, 40 and 50.

Figure 2:
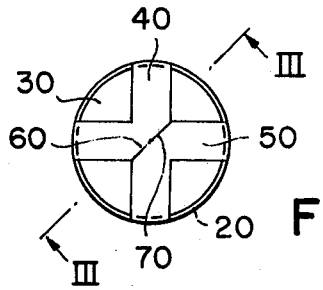
FIG. 2 is a top view of the bullet tip.

In FIG. 2, the two steel tips, 40 and 50, are embedded in lead 30 which is surrounded by a copper jacket 20. The steel tips, 40 and 50, form an X with the bases 60 and 70 of each tip flush together, forming a shear line between the V shaped segments.

Figure 3:
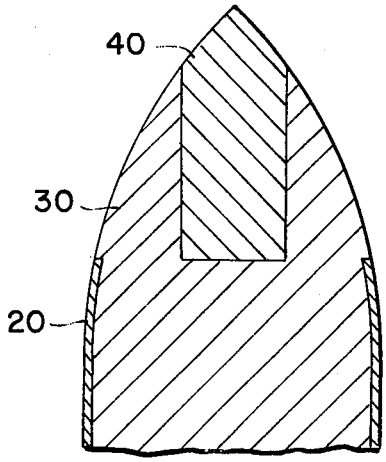
FIG. 3 is a section of FIG. 2, taken along the plane 3—3.

In FIG. 3, the copper jacket 20 surrounds the lead bullet 30 and the steel tip 40 is seen imbedded in the lead 30 and above the copper jacket 20. This permits the steel tips, 40 and 50 to move out of the bullet, as the bullet mushrooms inside an animal and continue on, crushing bones and insuring that the bullet will penetrate as far as possible into the internal tissues of the animal. The division of the steel tip into two sections permits flexibility in the way the tip can penetrate into and fracture bones.

Figure 4:
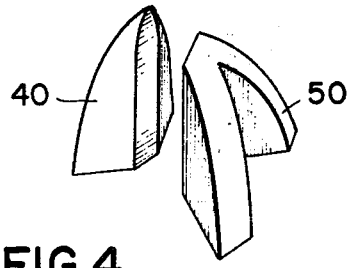
FIG. 4 is an exploded view of the two steel tips of the bullet.

In FIG. 4, the steel tips, 40 and 50, are each V-shaped ogive segments designed to penetrate bones.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A bone piercing hunting bullet, comprising:

a lead bullet, a copper jacket surrounding a lower portion of the bullet, a first V shaped ogive segment steel tip, a second V shaped ogive segment steel tip mounted with a base of the second V segment flush with a base of the first V segment, forming an X shaped steel tip assembly with a shear line between the V segments, the X shaped steel tip assembly mounted in the ogive tip of the lead bullet, whereby the steel tips may continue to penetrate into an animal as the lead tip of the bullet mushrooms in the tissues of an animal.

* * * * *